US008496190B2

(12) United States Patent
Chen

(10) Patent No.: US 8,496,190 B2
(45) Date of Patent: Jul. 30, 2013

(54) GARDEN HOSE SPRAYER

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 247 days.

(21) Appl. No.: 13/113,076

(22) Filed: May 23, 2011

(65) Prior Publication Data

US 2012/0298778 A1 Nov. 29, 2012

(51) Int. Cl.
*A62C 31/02* (2006.01)

(52) U.S. Cl.
USPC ..... 239/394; 239/526

(58) Field of Classification Search
USPC ..... 239/394, 395, 392, 451, 456, 457, 239/526, 436, 437
See application file for complete search history.

(56) References Cited

U.S. PATENT DOCUMENTS 4,541,568 A * 9/1985 Lichfield ..... 239/441
5,236,129 A * 8/1993 Grime et al. ..... 239/528
5,984,207 A * 11/1999 Wang ..... 239/526
6,427,931 B1 * 8/2002 Guo ..... 239/526
7,080,795 B2 * 7/2006 Chen ..... 239/394

* cited by examiner

*Primary Examiner* — Davis Hwu

(57) ABSTRACT

A garden hose sprayer has a main body, an adjusting member, a flow control shaft, a spray head, a pressing handle, the two stopping knobs and an axial rod. The pressing handle is capable of staying in a fixed compressed status, and the adjusting member can drive the flow control shaft to rotate to provide adjustable flow after the pressing handle is fixed.

6 Claims, 7 Drawing Sheets

GARDEN HOSE SPRAYER

BACKGROUND OF THE INVENTION

1. Field of the Invention

The present invention relates to a garden hose sprayer, and more particularly to a garden hose sprayer capable of providing a constant water output and an adjustable flow without pressing.

2. Description of the Related Art

One important job for gardening is watering the plants, which requires a hose to bring the water and to cover a large area. However, hoses can only provide a single strong water stream; by attaching a sprayer to the hose one can change the water stream into a mist for a better watering effect.

Most sprayers are designed to be controlled by way of a manual pressing force; therefore, users need to keep pressing a handle to keep the water flowing. Therefore, it becomes uncomfortable for the user and is also difficult to maintain the same pressing strength. Although some sprayers can be adjusted to provide a constant flow without being pressed, the output flow is not adjustable.

Therefore, it is desirable to provide a garden hose sprayer to mitigate and/or obviate the aforementioned problems.

SUMMARY OF THE INVENTION

An objective of the present invention is to a garden hose sprayer.

In order to achieve the above-mentioned objective a garden hose sprayer has: a main body, an adjusting member, a flow control shaft, a spray head, a pressing handle, stopping knobs and an axial rod. The main body has a control channel, and the control channel has an outlet slot at a front end and a through aperture at a rear end and connecting to an inlet channel in a grip handle at a bottom side. The grip handle has a control valve biased outwardly by a spring and is inserted into the inlet channel. The grip handle further has a first pivoting member and a second pivoting member above and below a position corresponding to the control valve. The second pivoting member has a sliding track, and the sliding track has an engaging gap adjacent to a side of the grip handle. The adjusting member further has a rotatable knob, an engaging aperture at a central section and a passing aperture on a bottom face. The flow control shaft has a tubal inlet section at a front end and an opening on a side of the inlet section such that the opening is connected to an inner space of the inlet section. The flow control shaft further has an engaging column corresponding to the engaging aperture, and a securing aperture disposed on the engaging column. The spray head has a connecting section. The pressing handle is a hollow housing and has a pivoting aperture and a plurality of opposing long apertures. The stopping knob has a connecting tube disposed in the long aperture of the pressing handle such that the stopping knob is capable of moving relative to the pressing handle.

With the above mentioned structure the following benefits can be obtained: 1. With the combination of the stopping knob, the axial rod, the sliding track and the engaging gap, the user does not need to keep pressing the pressing handle to maintain a constant flow of water. 2. The control channel has the flow control shaft, the flow control shaft further has the inlet section and the opening; when the adjusting member is pushed, the flow of the sprayer can be adjusted while the pressing handle is fixed, which is very convenient for the user.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
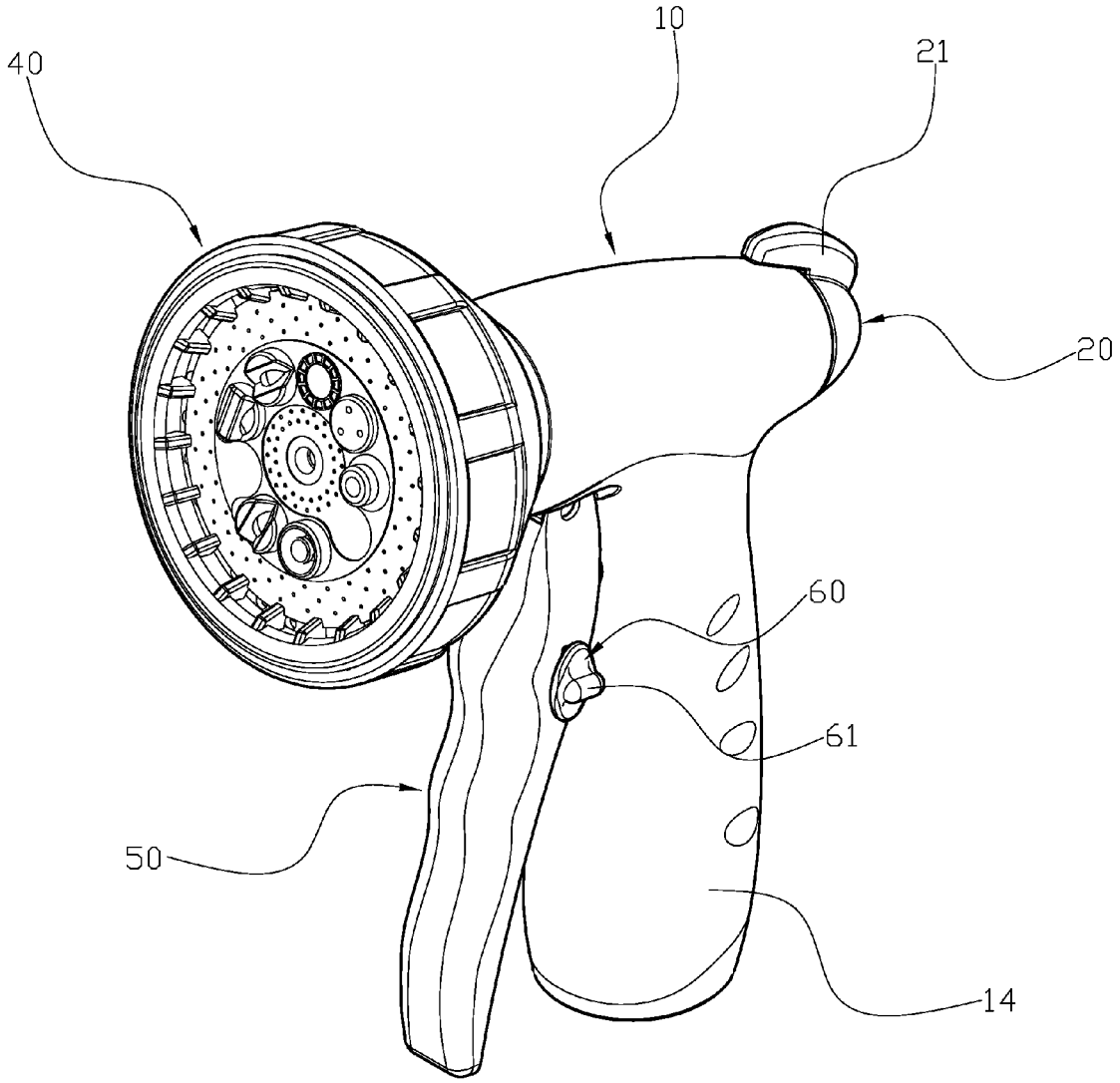
FIG. 1 is a perspective view of an embodiment of the present invention.
Figure 2:
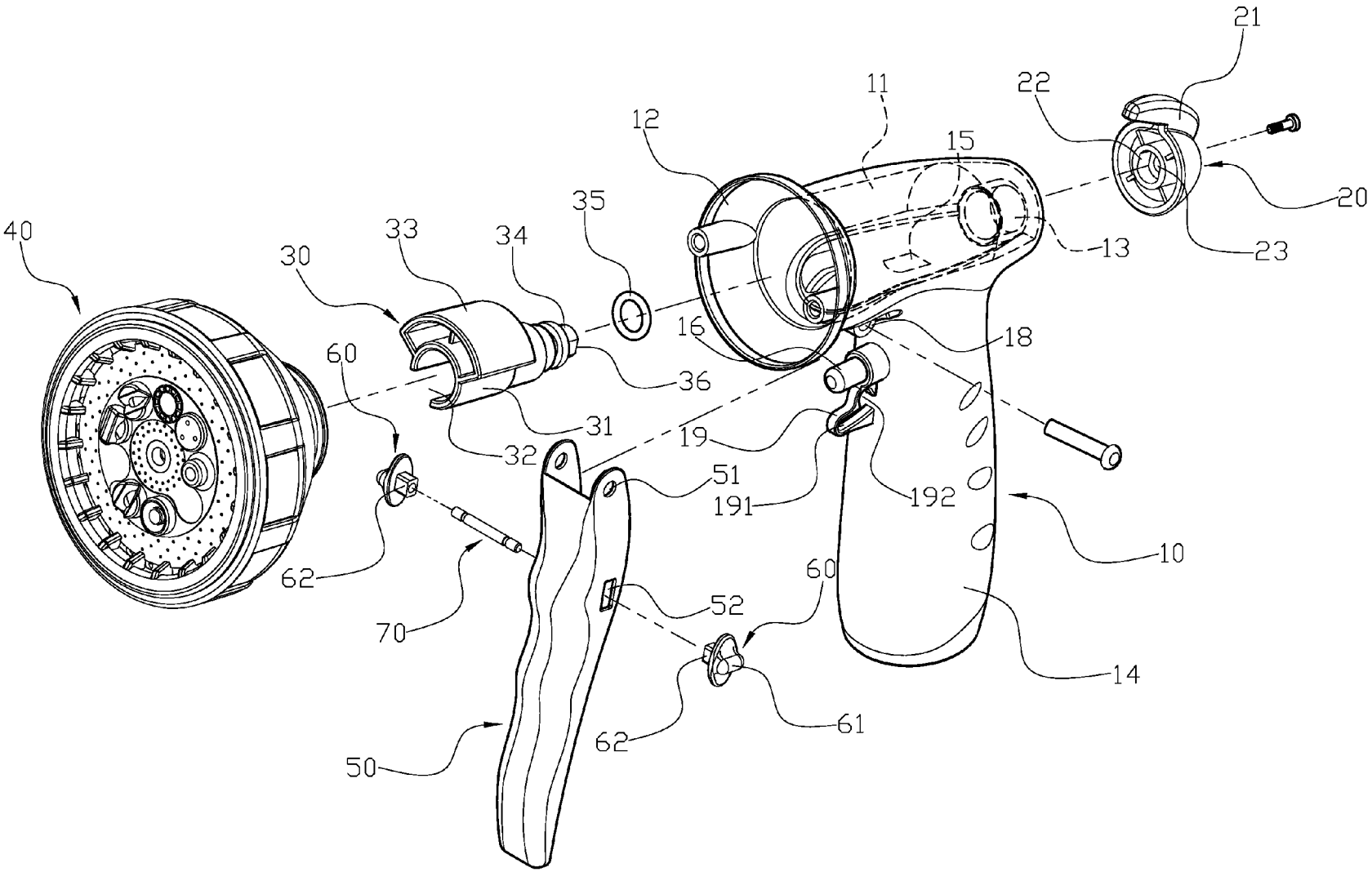
FIG. 2 is a perspective exploded view of an embodiment of the present invention.

Please refer to FIG. 1 and FIG. 2. A garden hose sprayer comprises: a main body 10, an adjusting member 20, a flow control shaft 30, a spray head 40, a pressing handle 50, two stopping knobs 60 and an axial rod 70. The main body 10 has a control channel 11, and the control channel 11 has an outlet slot 12 at a front end and a through aperture 13 at a rear end and is connected to an inlet channel 15 in a grip handle 14 at a bottom side. The grip handle 14 further has a control valve 16 biased outwardly by a spring 17 and inserted into the inlet channel 15, and the grip handle 14 further has a first pivoting member 18 and a second pivoting member 19 above and below a position corresponding to the control valve 16. The second pivoting member 19 has a sliding track 191, and the sliding track 191 has an engaging gap 192 adjacent to a side of the grip handle 14. The adjusting member 20 further has a rotatable knob 21, an engaging aperture 22 at a central section and a passing aperture 23 on a bottom face. The flow control shaft 30 has a tubal inlet section 31 at a front end and an opening 32 on a side of the inlet section 31 such that the opening 32 is connected to an inner space of the inlet section 31 and a fan-shaped stopper 33 at another side of the inlet section 31. The flow control shaft 30 further has an engaging column 34 corresponding to the engaging aperture 22, and a securing aperture 33 disposed on the engaging column 34. The spray head 40 has a connecting section. The pressing handle 50 is a hollow housing and has a pivoting aperture 51 and two opposing long apertures 52. The stopping knob 60 has a connecting tube 62 disposed in the long aperture 52 of the pressing handle 14 and a raised portion 61 at an outer surface such that the stopping knob 60 is capable of moving relative to the pressing handle 14.

Figure 3:
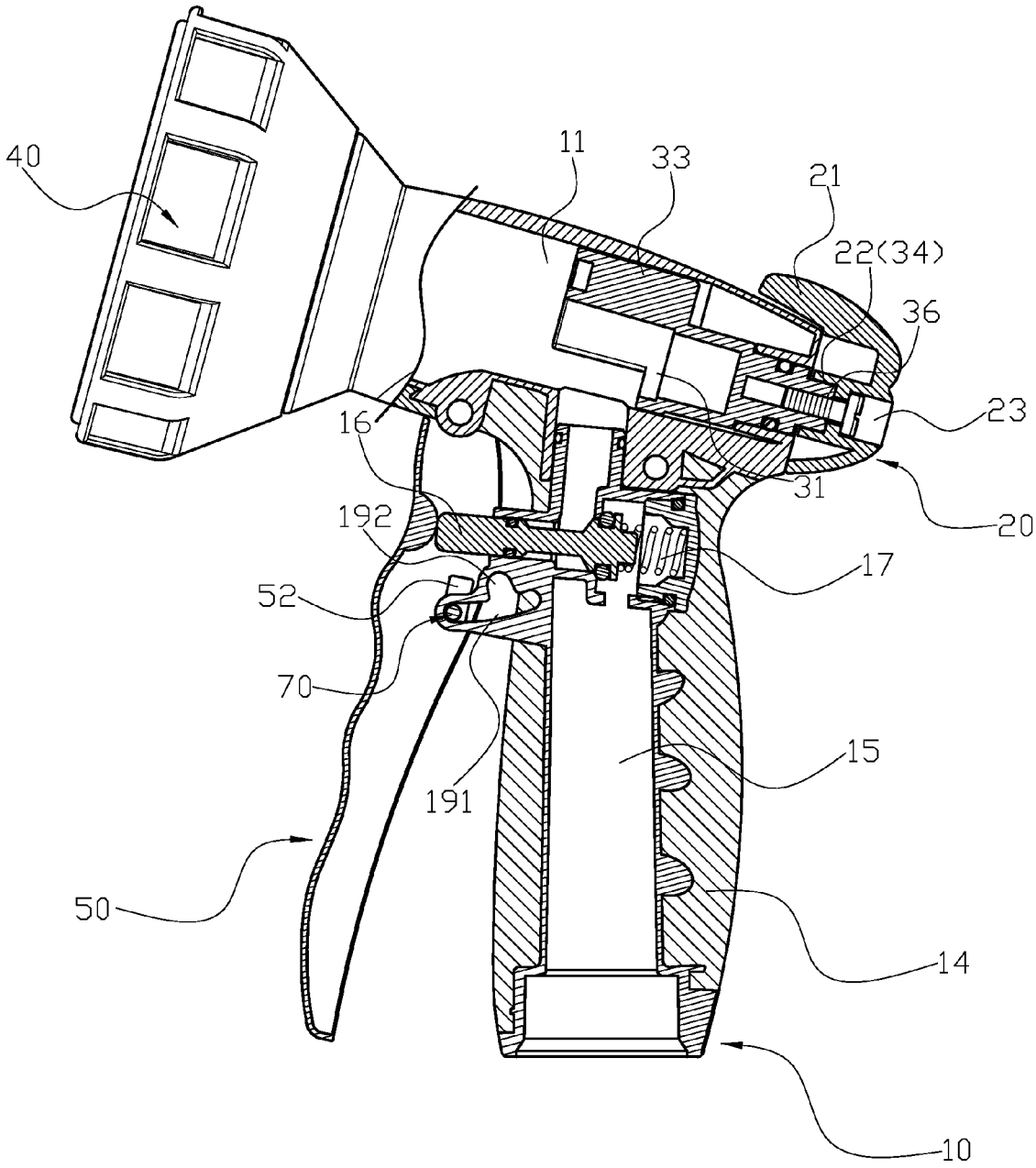
FIG. 3 is a cross-sectional view of an embodiment of the present invention.

For assembly, please refer to FIG. 1 and FIG. 3. The flow control shaft 30 is disposed in the control channel 11 of the main body 10. The engaging column 34 extends from the through aperture 13 and engages with the engaging aperture 22 of the adjusting member 20 behind the main body 10. The adjusting member is inserted through the passing aperture 23 and secured with the securing aperture 36 of the flow control shaft 30 such that the adjusting member 20 and the flow control shaft 30 are connected together. When the rotatable knob 21 of the adjusting member 20 is rotated, the flow control shaft 30 simultaneously rotates; the spray head 40 utilizes the connecting section to connect the spray head 40 onto the outlet slot 12 of the main body 10. The pressing handle 50 is pivoted onto the first pivoting member 18 of the main body 10 via the pivoting aperture 51. The axial rod 70 is placed in and extending from the sliding track 191 of the second pivoting member 19, and when the pressing handle 50 is rotate towards the main body 10, the connecting tube 62 of the two stopping knobs 60 are respectively placed in the long apertures 52 of the pressing handle 50, such that both of the connecting tubes 62 are connected to two sides of the axial rod 70 and the control valve 16 pushed by the spring 17 pushes against the pressing handle 50.

Figure 4:
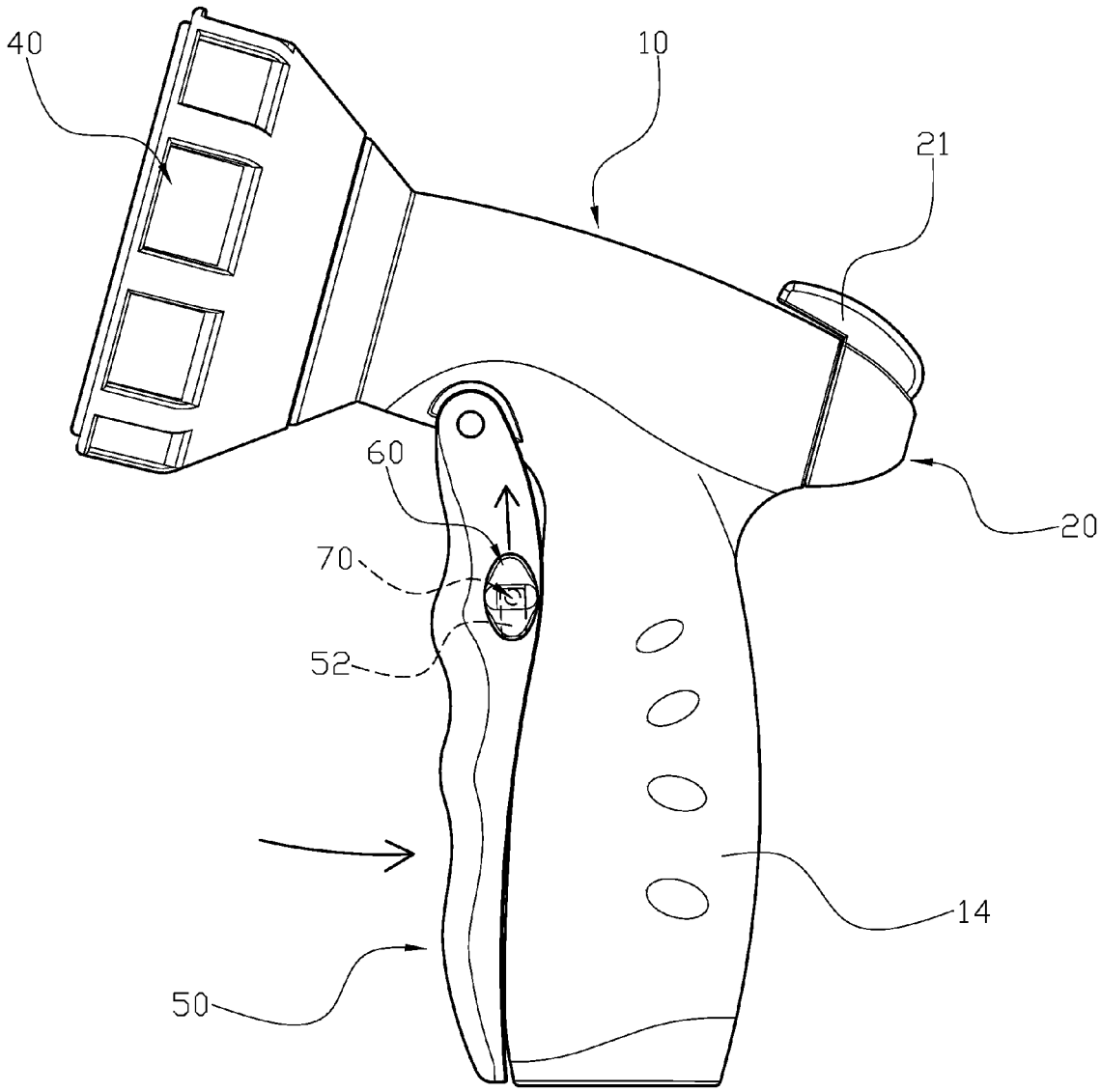
FIG. 4 is a schematic drawing showing a garden hose sprayer being pressed and held according to an embodiment of the present invention.
Figure 5:
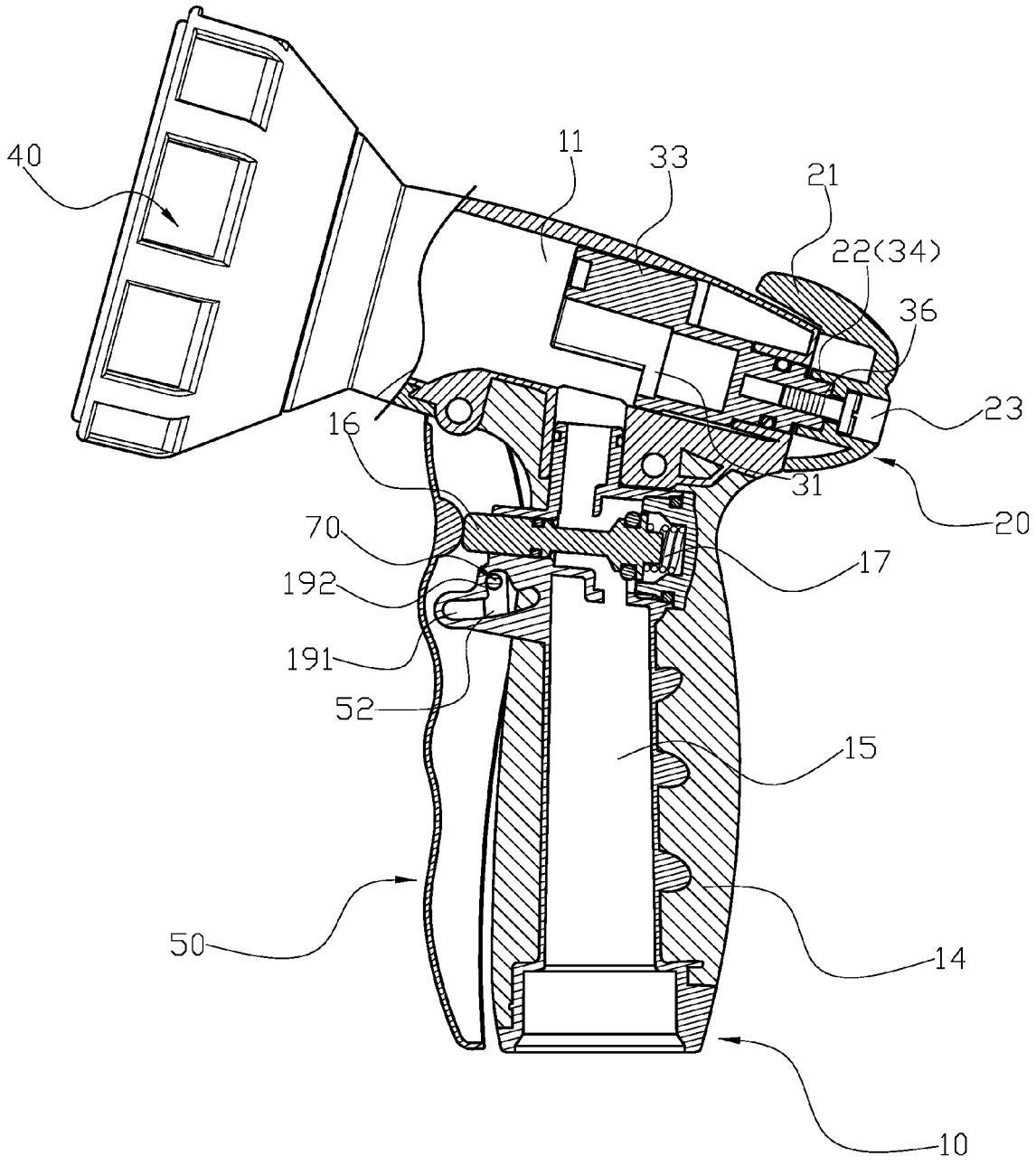
FIG. 5 is a cross-sectional view showing a garden hose sprayer being pressed and held according to an embodiment of the present invention.

In use, a user presses the pressing handle 50 to cause the control valve 16 to move inwardly and open the inlet channel 15 such that water entering from the inlet channel 15 is guided by the control channel 11 to be sprayed from the spray head 40. While the pressing handle 50 is pressed, the axial rod 70 slides along the sliding track to smooth the pressing process and avoid interference. Again, when the pressing handle 50 is pressed completely, the stopping knob 60 pushes upwardly to drive the connecting tube 62 and the axial rod 70 to move in the long aperture 52 (as shown in FIG. 4 and FIG. 5). Meanwhile, the axial rod 70 engages with the engaging gap 192 of the main body 10, therefore, the pressing handle 50 and the control valve 16 are kept being pressed down, and the water flow is continuous without the user needing to keep pressing the pressing handle 50.

Figure 6:
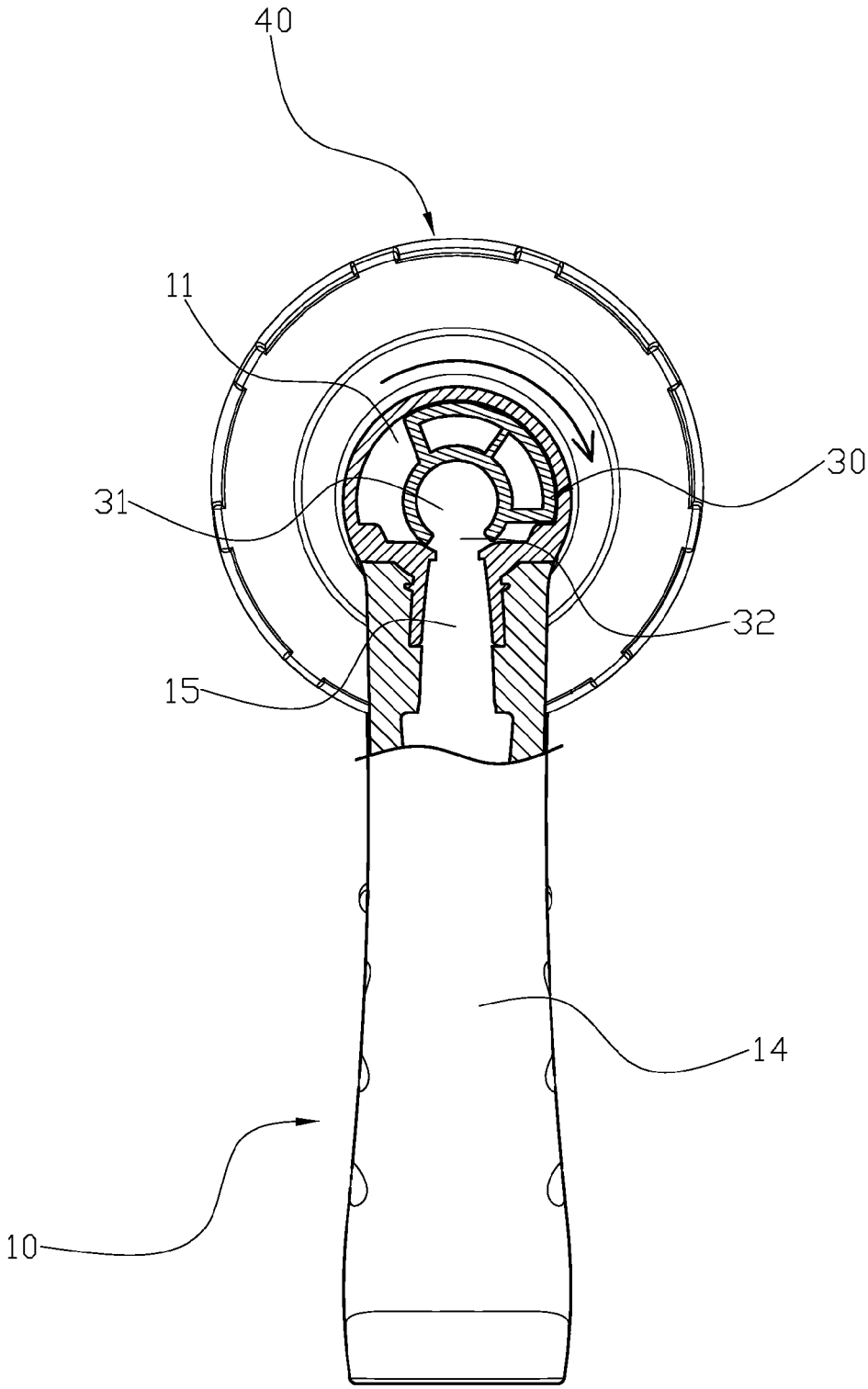
FIG. 6 illustrates an embodiment garden hose sprayer controlling output flow.
Figure 7:
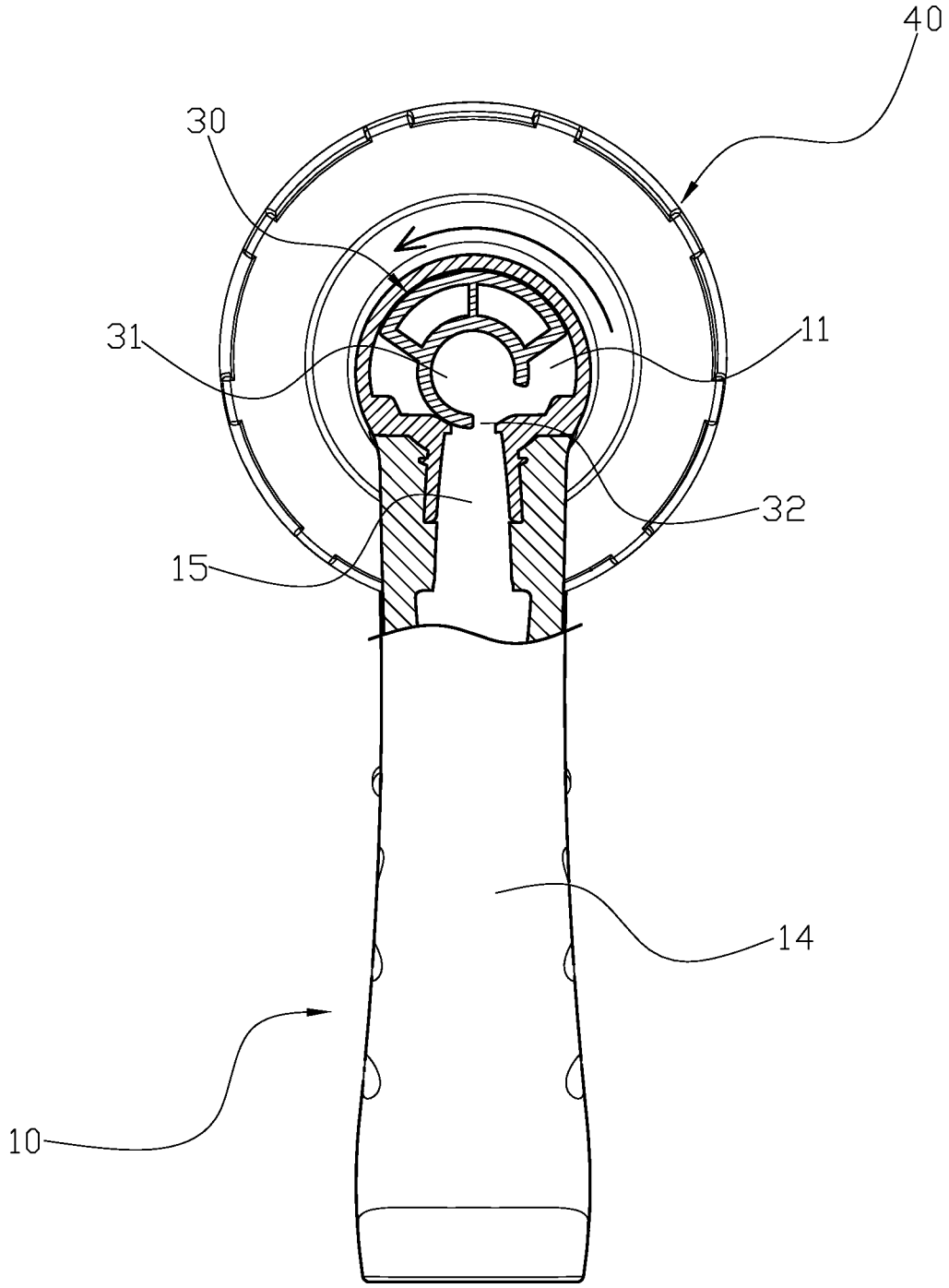
FIG. 7 is another illustration of an embodiment garden hose sprayer controlling output flow.

Alternatively, as shown in FIG. 6 and FIG. 7, when the pressing handle 50 is held at a pressed-in position to continuously output water, the adjusting member 20 drives the flow control shaft 30 to rotate to provide an adjustable flow after the pressing handle 50 is fixed. When the adjusting member 20 is pushed by the rotatable knob 21, due to the connection between the engaging column 34 and the engaging aperture 22, the flow control shaft 30 is driven to rotate in the same direction. During the rotation, the opening 32 and the inlet channel 15 cover each other to change an entering opening of the inlet section 31; when the opening is larger, more water enters into the inlet section 31 for discharge, and vice versa.

With the above mentioned structure the following benefits can be obtained: 1. With the combination of the stopping knob 60, the axial rod 70, the sliding track 191 and the engaging gap 192, the user does not need to keep pressing the pressing handle 50 to maintain a constant flow of water. 2. The control channel 11 has the flow control shaft 30, the flow control shaft 30 further has the inlet section 31 and the opening 32; when the adjusting member 20 is pushed, the flow of the sprayer can be adjusted while the pressing handle 50 is fixed, which is very convenient for the user.

Although the present invention has been explained in relation to its preferred embodiment, it is to be understood that many other possible modifications and variations can be made without departing from the spirit and scope of the invention as hereinafter claimed.

What is claimed is:

1. A garden hose sprayer comprising: a main body, an adjusting member, a flow control shaft, a spray head, a pressing handle, stopping knobs and an axial rod, wherein the main body has a control channel, the control channel having an outlet slot at a front end and a through aperture at a rear end and connecting to an inlet channel in a grip handle at a bottom side, the grip handle further having a control valve biased outwardly by a spring and inserted into the inlet channel, the grip handle further having a first pivoting member and a second pivoting member above and below a position corresponding to the control valve, the second pivoting member having a sliding track, and the sliding track having an engaging gap adjacent to a side of the grip handle;

the adjusting member further having a rotatable knob, an engaging aperture at a central section and a passing aperture on a bottom face;

the flow control shaft having a tubal inlet section at a front end and an opening on a side of the inlet section such that the opening is connected to an inner space of the inlet section, the flow control shaft further having an engaging column corresponding to the engaging aperture, and a securing aperture disposed on the engaging column;

the spray head having a connecting section;

the pressing handle being a hollow housing and having a pivoting aperture and a plurality of opposing long apertures; and the stopping knob having a connecting tube disposed in the long aperture of the pressing handle such that the stopping knob is capable of moving relative to the pressing handle;

wherein the flow control shaft is disposed in the control channel of the main body, the engaging column extends from the through aperture and engages with the engaging aperture of the adjusting member behind the main body, the adjusting member insertable through the passing aperture and secured with the securing aperture of the flow control shaft such that the adjusting member and the flow control shaft are connected together, and when the rotatable knob of the adjusting member is rotated, the flow control shaft simultaneously rotates, the spray head utilizes the connecting section to connect the spray head onto the outlet slot of the main body; the pressing handle pivoted onto the first pivoting member of the main body via the pivoting aperture, the axial rod placed in and extending from the sliding track of the second pivoting member, and when the pressing handle is rotate towards the main body, the connecting tube of the stopping knobs are respectively placed in the long apertures of the pressing handle, such that the connecting tubes are connected to sides of the axial rod and the control valve pushed by the spring pushes against the pressing handle.

2. The garden hose sprayer as claimed in claim 1, wherein the engaging aperture of the adjusting member has a non-circular polygonal shape or an elliptical shape.

3. The garden hose sprayer as claimed in claim 1, wherein the flow control shaft further has a fan-shaped stopper at another side of the inlet section.

4. The garden hose sprayer as claimed in claim 1, wherein the engaging column of the flow control shaft has a non-circular polygonal shape or an elliptical shape.

5. The garden hose sprayer as claimed in claim 1, wherein the engaging column of the flow control shaft is jacketed with a sealing ring.

6. The garden hose sprayer as claimed in claim 1, wherein the stopping knob has a raised portion at an outer surface.

* * * * *